US006802642B2

(12) United States Patent
Fallenius

(10) Patent No.: US 6,802,642 B2
(45) Date of Patent: Oct. 12, 2004

(54) METHOD FOR MIXING LIQUID IN A CONTAINER AND THE CONTAINER FOR CARRYING OUT THE METHOD

(75) Inventor: Per-Ivar Fallenius, Knektvägen 12, SE-444 41, Stenungsund (SE)

(73) Assignee: Per-Ivar Fallenius (SE)

( * ) Notice: Subject to any disclaimer, the term of this patent is extended or adjusted under 35 U.S.C. 154(b) by 55 days.

(21) Appl. No.: 10/220,938

(22) PCT Filed: Mar. 5, 2001

(86) PCT No.: PCT/SE01/00456

§ 371 (c)(1),
(2), (4) Date: Sep. 5, 2002

(87) PCT Pub. No.: WO01/70383

PCT Pub. Date: Sep. 27, 2001

(65) Prior Publication Data

US 2003/0103411 A1 Jun. 5, 2003

(51) Int. Cl.[7] ..... B01F 11/00
(52) U.S. Cl. ..... 366/208
(58) Field of Search ..... 366/208–211, 213–214, 366/216, 219, 602

(56) References Cited

U.S. PATENT DOCUMENTS 1,885,757 A * 11/1932 Orlopp ..... 206/219
5,209,565 A * 5/1993 Goncalves ..... 366/130
5,397,178 A * 3/1995 Konietzko ..... 366/197
5,603,569 A * 2/1997 Salomon et al. ..... 366/347
5,645,347 A * 7/1997 Draenert ..... 366/242
6,071,006 A * 6/2000 Hochstein et al. ..... 366/247
6,431,745 B1 * 8/2002 Schlumberger ..... 366/211

FOREIGN PATENT DOCUMENTS

DE 19709237 A1 * 9/1998
EP 0356883 8/1989
WO 02/11872 A1 * 2/2002

* cited by examiner

*Primary Examiner*—Charles E. Cooley
(74) *Attorney, Agent, or Firm*—Orum & Roth

(57) ABSTRACT

The invention relates on the one hand to a method for bringing about mixing of a liquid (4) in a container (1) filled for the most part with liquid, and on the other hand to an aforementioned container (1) for carrying out the method. The container (1) exhibits a partially closed opening (2) at its upper end (1A). The aforementioned opening (2) is smaller than the upper width of the container. The container (1) is so arranged as to be subjected to a circulating motion at the time of the mixing procedure, which causes the liquid (4) to start to rotate and to be forced outwards against the inner walls (7) of the container and upwards against the lid (2) of the container during mixing. The construction of the lid prevents the liquid (4) from flowing out through a hole (3) situated at the center (8) of the lid (2) and the container (1).

26 Claims, 6 Drawing Sheets

METHOD FOR MIXING LIQUID IN A CONTAINER AND THE CONTAINER FOR CARRYING OUT THE METHOD

The present invention relates to a method for bringing about mixing of a liquid in a container filled for the most part with liquid, which exhibits a partially closed opening at its upper end, which container is so arranged as to be subjected to motion in conjunction with the mixing procedure.

BACKGROUND TO THE INVENTION

In procedures for mixing samples in containers which have been filled for the most part with liquid, it may be necessary on certain occasions to mix the samples in the aforementioned containers, but without these being fully enclosed, in order to afford free access to the internal space of the containers and to be able to get to the samples without first having been obliged to open the containers in question. It is desirable for this to be capable of taking place during the actual mixing procedure in the containers. There is a wish to be able to utilize equipment which subjects the aforementioned containers, which are thus partially open at the top, and which are filled for the most part with liquid, to a circulating motion. It is important, therefore, for the content of the containers not to flow from the containers in question.

Objects of the Invention

The aforementioned objects include the principal object that it is wished to achieve in accordance with the present invention.

Principal Characteristics of the Invention

The aforementioned objects are achieved by means of a procedure in accordance with the present invention, which is characterized essentially in that the container is subjected to a circulating motion which causes the liquid to start to rotate and to be forced outwards against the inner walls of the container and upwards against the lid of the container during mixing, and in that the construction of the lid prevents the liquid from flowing out through a hole situated at the centre of the lid and the container.

Additional Objects of the Invention

It is desirable also to make available containers with lids which enable the aforementioned procedure to be executed effectively and reliably without the risk of the contents of the containers flowing out from the mouths of the containers located at the top during the mixing procedure, but which still permit free access to the internal space of the containers and without risk, for example when preparing samples in liquid form in conjunction with the analysis of samples in laboratories, for instance, so that the contents are not contaminated. This can occur, for example, if the tips of the pipettes with which the samples are transferred between containers come into direct contact with the edges of containers and openings.

Prior Art

Previously disclosed in EP 0 356 883 A1, for example, is the mixing of samples in cylindrical containers which are closed at the top with the help of lids, in which the possibility of pushing through pipette tips, for example, is provided. It is precisely in such cases that the risk is present of such contamination taking place, for example if one is engaged in the investigation of the degree of bacterial contamination of foodstuffs, for example in minced meat and fried diced meat and potatoes.

Additional Objects of the Invention

A further object of the present invention is thus to make available containers which are suitable for use in the procedure in accordance with the invention.

Additional Characteristics of the Invention

A container, which is provided with a lid with an opening and is suitable for use for carrying out a procedure in accordance with the present invention, is characterized essentially in that the container exhibits a lid which is provided with a hole arranged at the centre of the lid and the container, which hole is smaller than the diameter of the container.

DESCRIPTION OF THE DRAWINGS

The invention is described below as a preferred illustrative embodiment, in conjunction with which reference is made to the accompanying drawings, in which.

DESCRIPTION OF THE ILLUSTRATIVE EMBODIMENT

Figure 1:
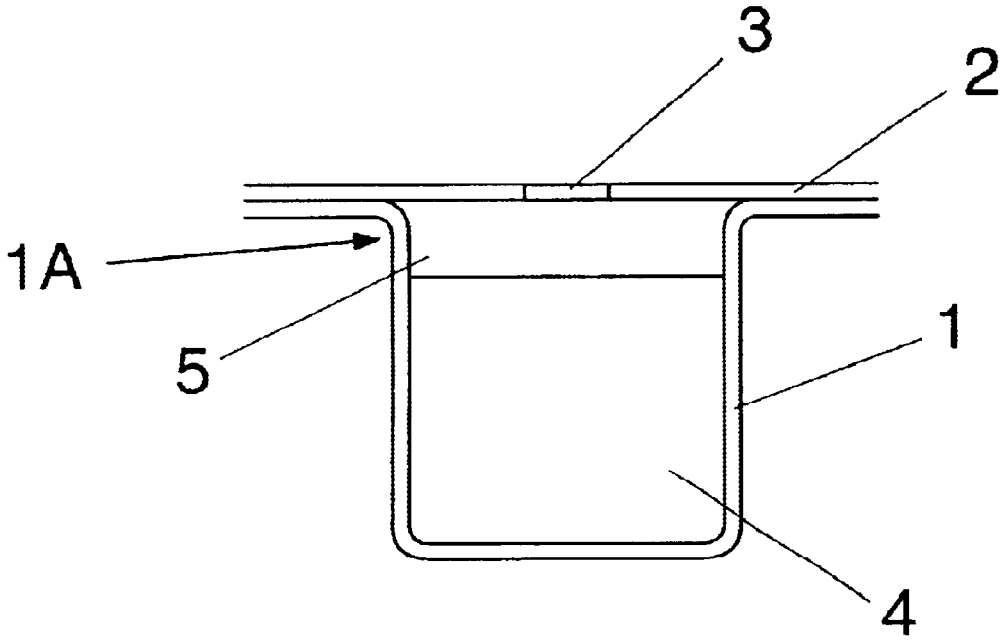
FIG. 1 shows a sectioned view of a container filled with liquid and in the rest position.
Figure 2:
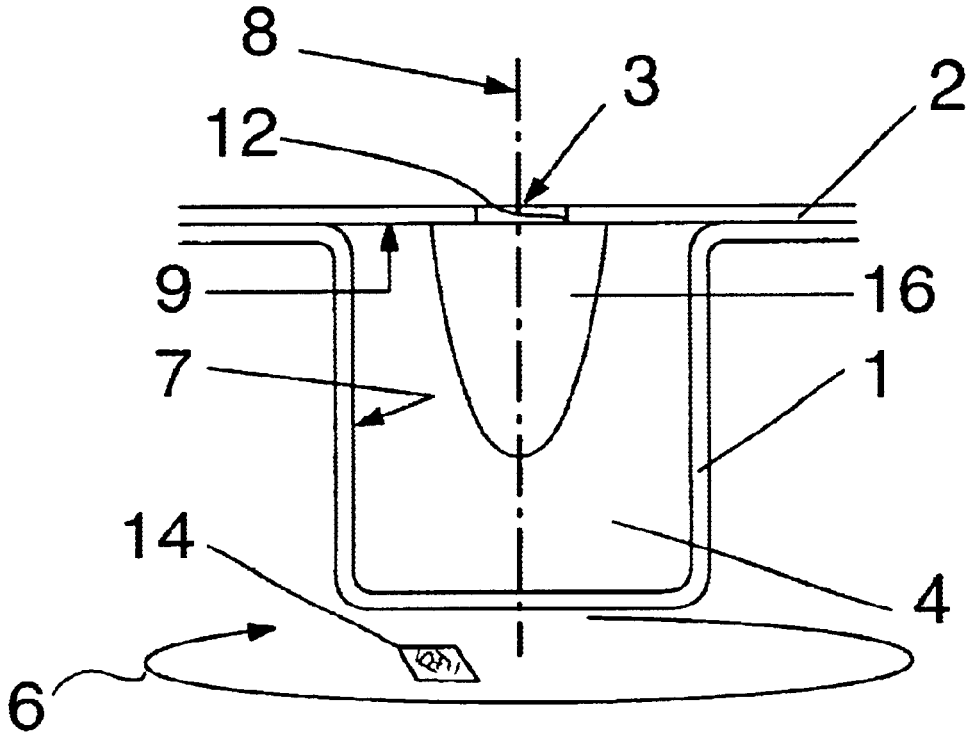
FIG. 2 shows the aforementioned filled container, which is subjected to a circular motion.

Illustrated in the drawings is a container 1 which, at its upper end 1A, is closed by a lid 2. The aforementioned lid 2 has at its centre a transcurrent hole 3. The aforementioned container 1, which can be executed as a small beaker, is for the most part filled with liquid 4 in its internal space 5. In FIG. 1 the container 1 is shown at rest, and in FIG. 2 the container 1 is shown during the period for which it is subjected to a circular motion 6 in either direction.

The invention is intended in the first instance to permit the preparation of samples in liquid form in conjunction with the analysis of samples, for example in laboratories, and comprises a beaker preferably with a circular circumference viewed around its periphery and consisting of a plastic material, which beaker has been closed from the outset with a lid 2 made of plastic material and with a similarly circular, centrally located hole 3, through which liquid 4 in the form of a sample and/or reagents can be added or drawn off. Thanks to the present design of the container 1, the liquid 4 in the container 1 can be mixed with the help of a suitable motion-imparting apparatus intended for the purpose, which means that the container 1 is subjected to a circular motion without causing liquid to flow out of the container through the central top hole 4.

Figure 3:
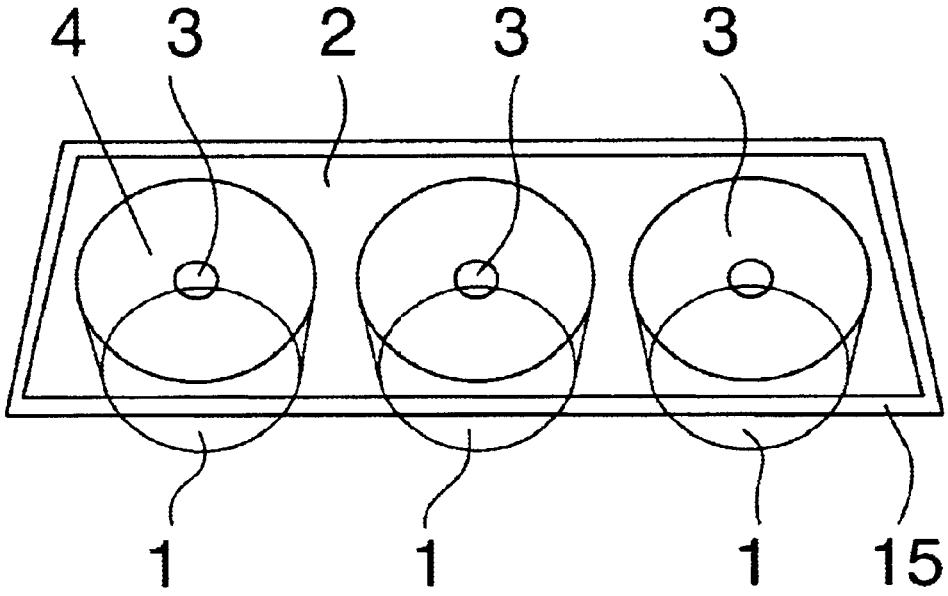
FIG. 3 shows a perspective view of linear, consecutive containers.

When the container 1 is caused to move with a circular motion, as shown in FIG. 3, for example, the liquid 4 is set in motion by centrifugal force and begins to rotate and is forced outwards against the inner wall 7 of the container and upwards against the lid 2 of the container during mixing, and the design of the lid prevents the liquid 4 from flowing out through a hole 3 at the upper end 1A of the container located at the centre 8 of the lid 2 and the container 1.

A liquid-free cavity 16 is formed in the liquid 4 in the centre of the container 1 at the top.

The liquid is thus mixed effectively by the fact that it acts against both the internal wall 7 of the container and against the internal surface 9 of the lid 2, outside the centrally located hole 3 viewed in the radial sense.

A flow is caused to occur in this way, and this causes the liquid 4 to be set in rotation rapidly, which facilitates mixing.

The container described in EP 0 356 883 A1 is provided with an opening lid, which is provided with slits to facilitate the penetration of the lid by a probe. These slits mean that the container is completely closed when they are not being activated by a probe. When the container is subjected to motion/mixture, this can take place by the application of considerable force without the risk of liquid leaking out because the container is completely closed.

With the construction illustrated in the aforementioned EP patent, there is also nothing to suggest that the slits could be dispensed with in a simple fashion.

The present container is provided with a lid which seals tightly against the edges of the container, and the lid is provided at its centre with an open hole, which means that the container is partially open during the mixing phase. Since our container is intended inter alia for use in the preparation of bacteriological samples, it is important that the tip of the pipette, with which liquid will be drawn from or added to the container, does not come into contact with any part of the top side/outside of the lid, as the sample would then be exposed to a high risk of becoming contaminated. This unfortunately takes place when a probe is passed down into the previously disclosed container, the lid of which is provided with slits.

Figure 6:
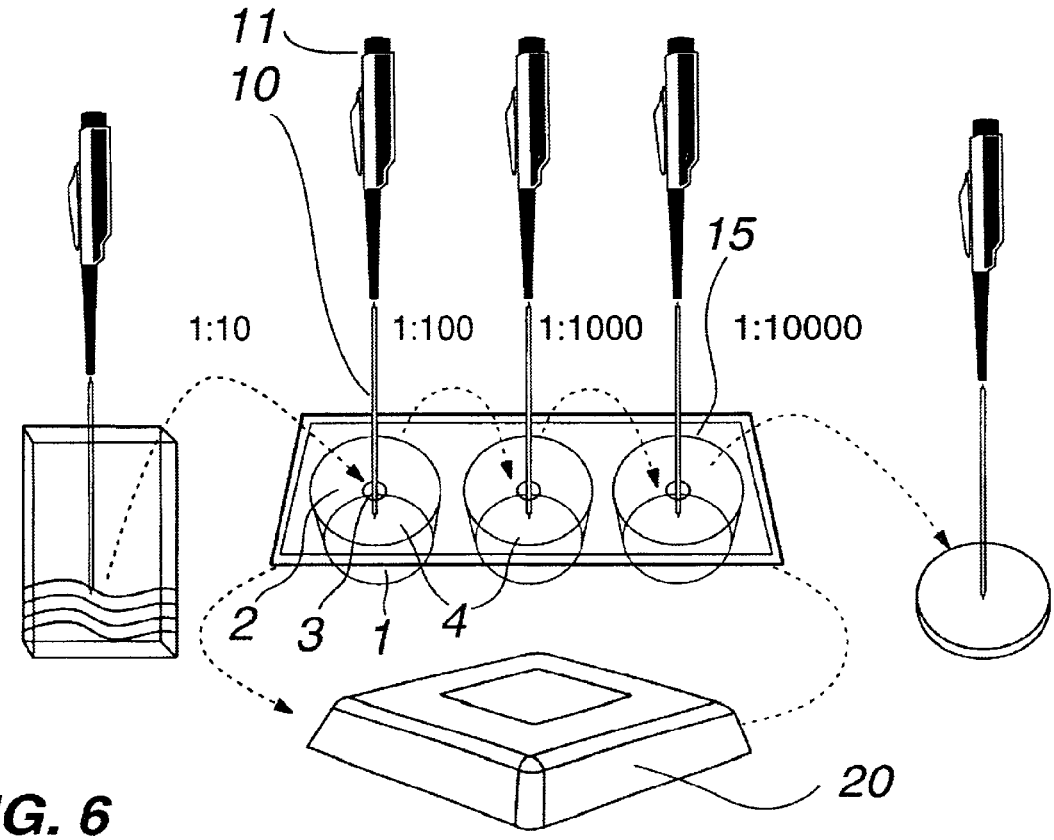
FIG. 6 shows a diagrammatic sampling and mixing procedure which is permitted thanks to the invention.

By determining the size of the hole 3 in the lid 2 of the container, the possibility is afforded for adding and drawing off liquid 4 from the container 1 during the actual mixing phase, but with the tip of a pipette 11, for example, touching the edge 12 of the hole 3. It is possible in this way to make working with the container 1 effective, for example when diluting liquid containing bacteria in conjunction with the preparation of bacteriological samples. This work involves the addition of 1 ml of liquid containing bacteria to a container containing 9 ml of dilution liquid 4 and mixing these (dilution ratio 1:10), and then taking 1 ml of the mixture and adding it to 9 ml of dilution fluid in a new container 1 and mixing these (dilution ratio 1:100). This procedure is then repeated until the desired dilution ratio is achieved. The ability to draw off and add samples while the liquid is rotating and being mixed enables this work to be performed more rapidly than if the container were to be stopped between each operation. See FIG. 6, which also shows a specially adapted shaking apparatus 20 in which a number of containers 1 can be placed in holders intended for the purpose.

By determining the size of the hole 3 at the centre of the lid 2 of the container so that its diameter is larger than the diameter of the rotating motion to which the container is subjected, in order to cause the liquid to rotate and thus to be mixed, it is possible to avoid coming into contact with the peripheral edge 12 of the hole 3.

In this way, a circular area with a diameter identical to the diameter of the hole minus the diameter of the rotating motion will be available at all times for access to the container. This allows access to the container with the tip of a pipette, for example, without this coming into contact with the lid while the liquid is being mixed; i.e. the container is subjected to circular motion in accordance with the previous description.

Figure 4:
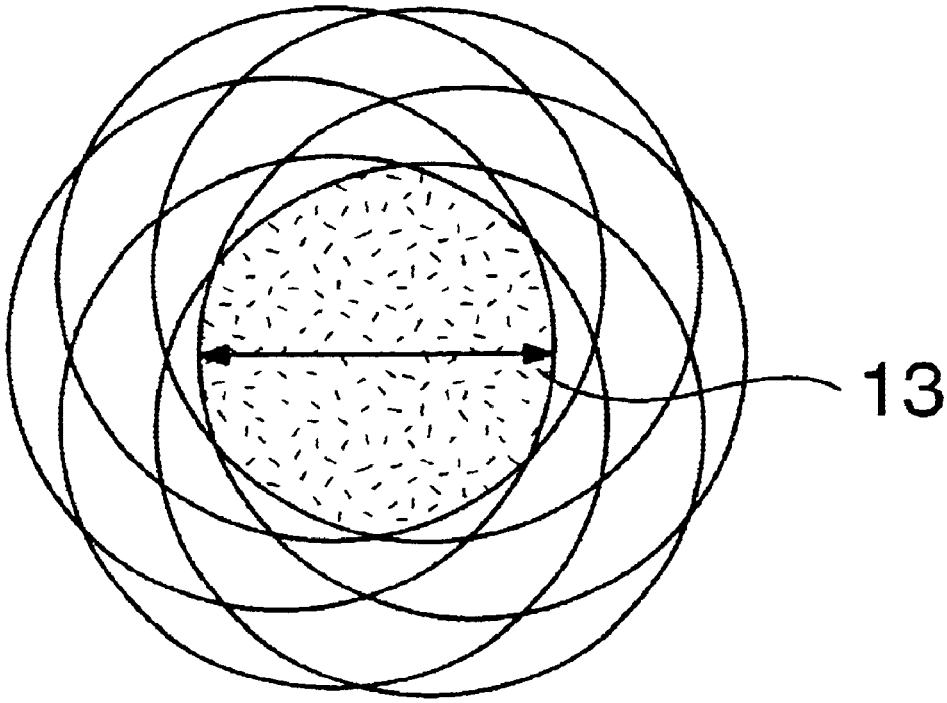
FIG. 4 shows a diagrammatic view with different positions for the lid holes of the container drawn in, viewed from above when the container is subjected to a rotating motion.
Figure 5:
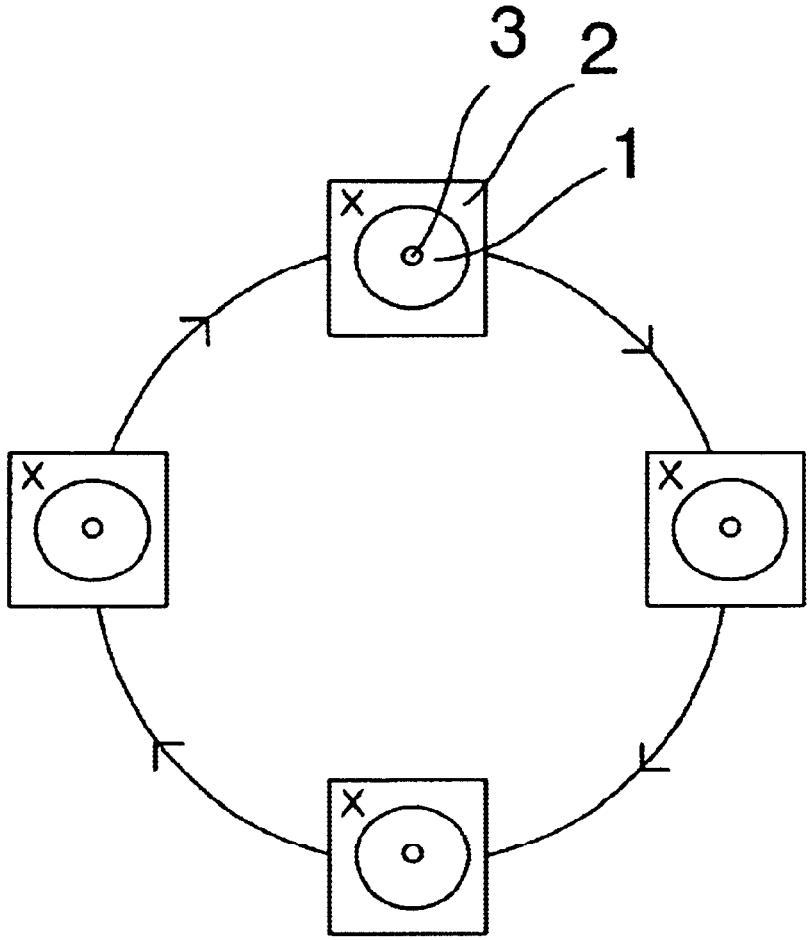
FIG. 5 shows an example of the circular motion to which the container is subjected and is illustrated in four different positions.

Various positions of the hole in the lid of the container viewed from above when the container is subjected to a rotating motion are shown in FIG. 4. The size of the hole in this example is 12 mm, and the diameter of the circular motion described by the container is 4 mm. This means that the free area 13, shown here with a broken line, via which the tip 10 of a pipette, for example, can gain access to the inside of the container without touching the lid 2, has a diameter of 8 mm.

The diameter of the aforementioned circulating motion is so arranged as to correspond at least to the diameter of the opening hole and should preferably be less than the aforementioned diameter. The centre of the motion to which the container 1 is subjected in order to act along an essentially horizontal plane 14 corresponds essentially to the centre 8 of the opening hole 3.

It is also possible to obtain the desired mixing effect if the rotary motion is greater than the diameter of the hole, although it is necessary to stop the shaking apparatus in order to be able to draw off liquid.

The container exhibits essentially straight walls or gently tapering walls and is formed preferably by a so-called blister pack. A number of containers 1 can thus be arranged joined together in a line and covered by a lid-forming strip 15 of plastic, which is provided with holes 3 directly in line with each of the containers 1 at the centre of these as indicated above. A tear-off strip, for example made of plastic film, can be arranged over the aforementioned holes 3, which retains the liquid 4 inside the container 1 during transport of the containers, but is torn off at the time of processing and mixing to expose the opening and the contents of the container.

The invention is naturally not restricted to the embodiment described above and illustrated in the accompanying drawings. Modifications are possible, especially with regard to the nature of the various components, or by the use of equivalent technology, without departing from the area of protection afforded to the invention as defined in

What is claimed is:

1. Method for bringing about mixing of a liquid in a container filled for the most part with liquid, which exhibits a lid partially closing an opening at its upper end, which container is so arranged as to be subjected to motion in conjunction with the mixing procedure, wherein the container is subjected to a circulating motion which causes the liquid to start to rotate and to be forced outwards against the inner walls of the container and upwards against the lid of the container during mixing, and in that the construction of the lid prevents the liquid from flowing through a hole situated at the center of the lid and the container.

2. Method in accordance with Patent claim 1, wherein the container is subjected to a circulating motion which exhibits a specific rotation diameter, and which is so arranged as to correspond at least to the diameter of the hole in the lid.

3. Method in accordance with Patent claim 2, wherein the container is subjected to a circulating motion which is so arranged as to act along an essentially horizontal plane.

4. Method in accordance with Patent claim 2, wherein a liquid can be added to, or a liquid can be drawn off from the container for mixing during the actual mixing phase through the opening hole in the lid.

5. Method in accordance with Patent claim 4, wherein the liquid can be added to or the liquid can be drawn off from the container by means of a pipette.

6. Method in accordance with Patent claim 1, wherein the container is subjected to a circulating motion, the diameter of which is less than the diameter of the hole in the lid.

7. Method in accordance with Patent claim 6, wherein the container is subjected to a circulating motion, the center of which corresponds essentially to the center of the opening hole.

8. Method in accordance with Patent claim 7, wherein the container is subjected to a circulating motion which is so arranged as to act along an essentially horizontal plane; and a liquid can be added to or a liquid can be drawn off from the container for mixing during the actual mixing phase through the opening hole in the lid.

9. Method in accordance with Patent claim 8, wherein the liquid can be added to or the liquid can be drawn off from the container by means of a pipette.

10. Method in accordance with Patent claim 7, wherein the container is subjected to a circulating motion which is so arranged as to act along an essentially horizontal plane.

11. Method in accordance with Patent claim 7, wherein a liquid can be added to, or a liquid can be drawn off from the container for mixing during the actual mixing phase through the opening hole in the lid.

12. Method in accordance with Patent claim 11, wherein the liquid can be added to or the liquid can be drawn off from the container by means of a pipette.

13. Method In accordance with Patent claim 6, wherein the container is subjected to a circulating motion which is so arranged a to act along an essentially horizontal plane.

14. Method in accordance with Patent claim 6, wherein a liquid can be added to, or a liquid can be drawn off from the container for mixing during the actual mixing phase through the opening hole in the lid.

15. Method in accordance with Patent claim 14, wherein the liquid can be added to or the liquid can be drawn off from the container by means of a pipette.

16. Method in accordance with Paten claim 1, wherein the container is subjected to a circulating motion which is so arranged as to act along an essentially horizontal plane.

17. Method in accordance with Patent claim 16, wherein a liquid can be added to, or a liquid can be drawn off from the container for mixing during the actual mixing phase through the opening hole in the lid.

18. Method in accordance with Patent claim 17, wherein the liquid can be added to or the liquid can be drawn off from the container by means of a pipette.

19. Method in accordance with Patent claim 1, wherein a liquid can be added to, or a liquid can be drawn off from the container for mixing during the actual mixing phase through the opening hole in the lid.

20. Method in accordance with Patent claim 19, wherein the liquid can be added to or the liquid can be drawn off from the container by means of a pipette.

21. The method of claim 1 wherein the hole in the lid is smaller than the diameter of the container.

22. The method of claim 21, wherein the container and the hole in the lid both exhibit a circular peripheral form.

23. The method of claim 22, wherein the container exhibits essentially straight walls.

24. The method of claim 21, wherein the container an the lid are comprised of a plastic material.

25. The method of claim 21, wherein the container exhibits essentially straight walls.

26. Method for bringing about mixing of a liquid in a contain r filled for the most part with liquid, which exhibits a lid partially closing an opening at its upper end, which container is so arranged as to be subjected to motion in conjunction with the mixing procedure, wherein the container is subjected to a circulating motion which causes the liquid to start to rotate and to be forced outwards against the inner walls of the container and upwards against the lid of the container during mixing, and in that the construction of the lid prevents the liquid from flowing through a hole situated at the center of the lid and the container.

* * * * *